US005209024A

United States Patent [19]

Carpenter et al.

[11] Patent Number: 5,209,024

[45] Date of Patent: May 11, 1993

[54] INEXPENSIVE ABRASIVE BLAST WHEEL

[75] Inventors: James H. Carpenter, Hagerstown; Horace A. Bailey, Smithsburg, both of Md.

[73] Assignee: Pangborn Corporation, Hagerstown, Md.

[21] Appl. No.: 780,338

[22] Filed: Oct. 22, 1991

[51] Int. Cl.[5] ..... B24C 5/06

[52] U.S. Cl. ..... 51/434; 51/435; 51/432; 51/431

[58] Field of Search ..... 51/428, 431, 432, 434, 51/435

[56] References Cited

U.S. PATENT DOCUMENTS

| | | | |
|---|---|---|---|
| 2,077,637 | 4/1937 | Minich | 51/431 |
| 2,204,632 | 6/1940 | Turnbull | 51/432 |
| 3,745,711 | 7/1973 | Haberlin | 51/434 |
| 4,447,993 | 5/1984 | Laido | 51/435 |
| 4,480,413 | 11/1984 | Schulte | 51/435 |
| 4,646,483 | 3/1987 | Mangan | 51/435 |
| 4,649,673 | 3/1987 | Van Huyssteen | 51/435 |
| 4,751,798 | 6/1988 | McDade | 51/435 |
| 4,941,297 | 7/1990 | Carpenter | 51/435 |

FOREIGN PATENT DOCUMENTS

| | | | |
|---|---|---|---|
| 48409 | 9/1984 | Fed. Rep. of Germany | 51/431 |
| 48305 | 5/1983 | Japan | 51/435 |
| 48310 | 10/1983 | Japan | 51/431 |

*Primary Examiner*—Bruce M. Kisliuk

*Assistant Examiner*—Bo Bounkong

*Attorney, Agent, or Firm*—Charles E. Brown

[57] ABSTRACT

This relates to an inexpensive blast wheel for applying abrasive particles to work pieces to be cleaned. The blast wheel provides a simple arrangement for supporting vanes in the form of a hub having a bowl shaped portion in which bases of vanes are seated with the bases being clamped in place by a plate portion of an impeller. Each vane includes a wide base connected to the vane by way of a spacer. The impeller plate has a notch for each vane with the notch receiving the spacer and overlying the base. The bowl portion of the hub includes a peripheral flange which engages an outer end of the vane base to restrain it against radial outwardly directed movement. The vanes may be changed by providing the hub flange with a notch through which a vane base may pass. By loosening the impeller plate relative to the hub, and aligning each vane in sequence with respect to the notch, the vane may be slid through the notch and removed from the hub. With smaller vanes, the vanes may be assembled with the impeller and clamped in place by a hose clamp and then the entire impeller and vane arrangement assembled with the hub. There is also an impeller case which is positioned between the impeller member of the impeller and the vanes to control the path of abrasive particles. The case is rotatable relative to a guard housing for varying the path along which the abrasive particles are thrown.

21 Claims, 10 Drawing Sheets

FIG. 5
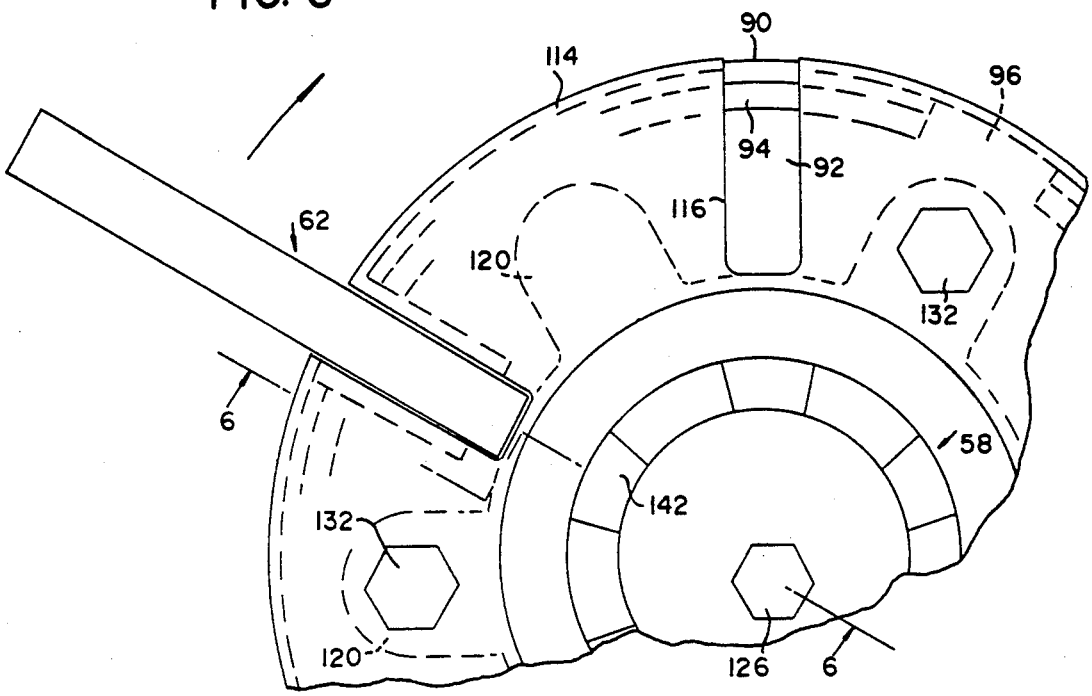
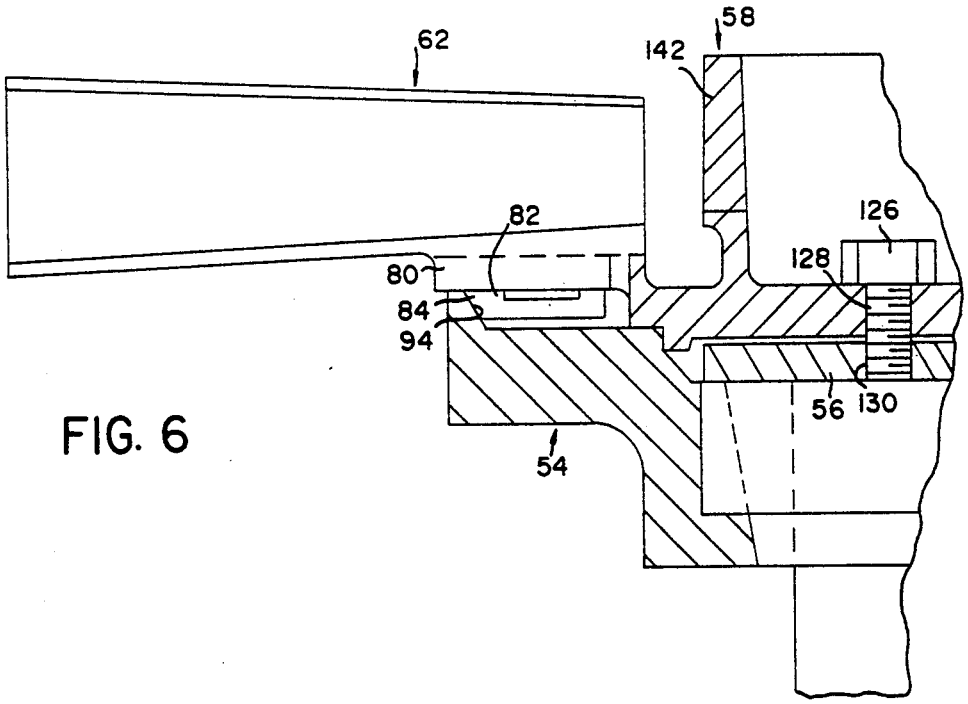
FIG. 6

FIG. 7
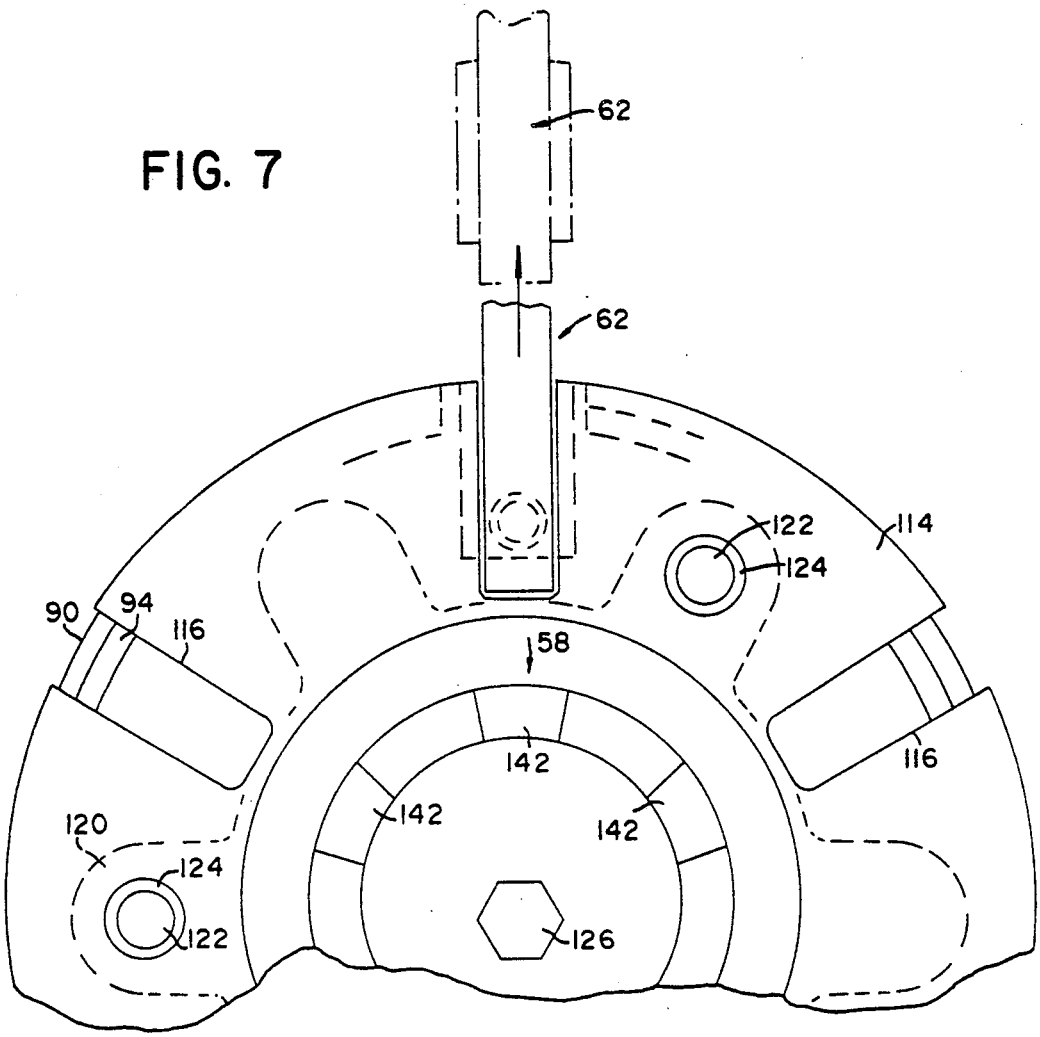
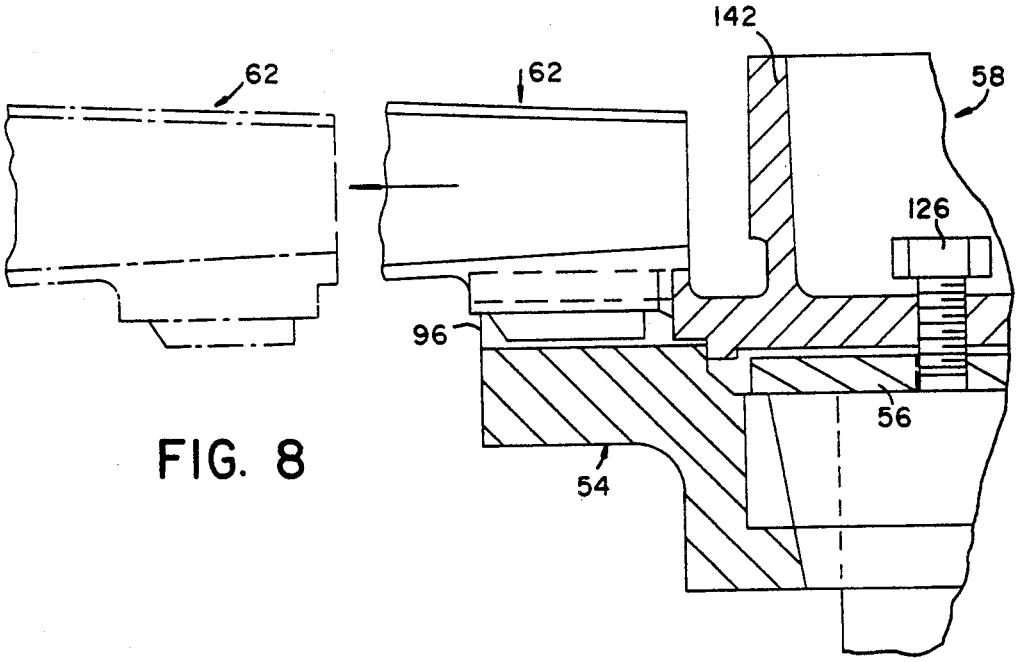
FIG. 8

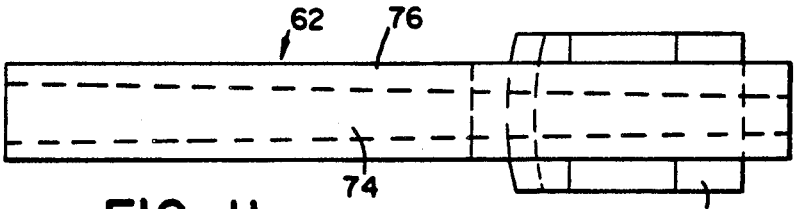
FIG. 11
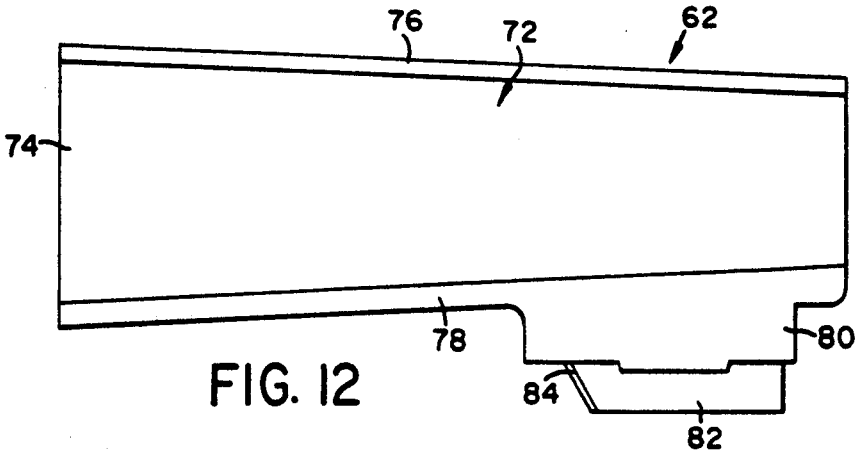
FIG. 12
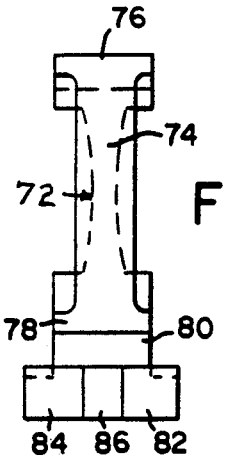
FIG. 13
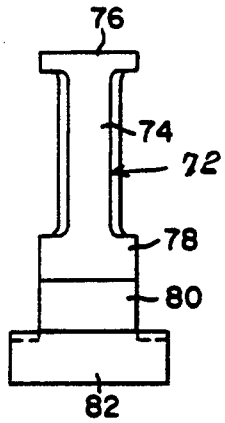
FIG. 14
FIG. 15
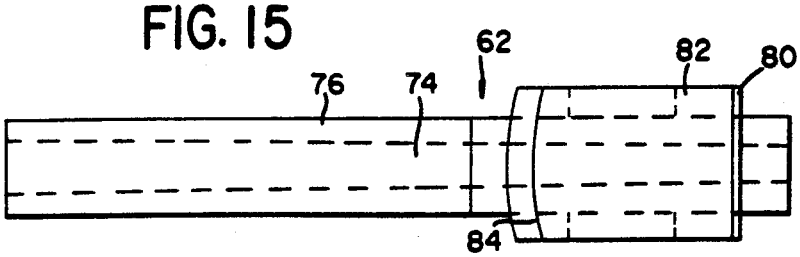

FIG.16
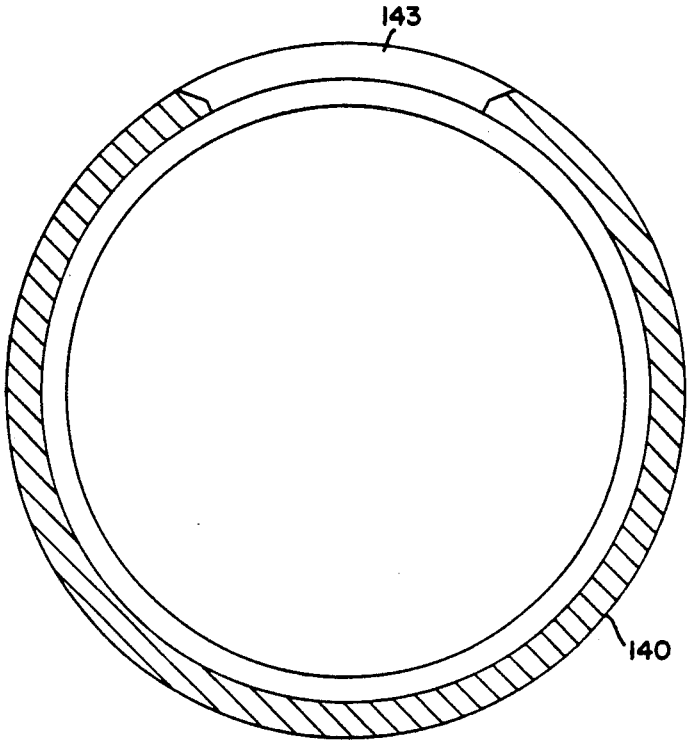
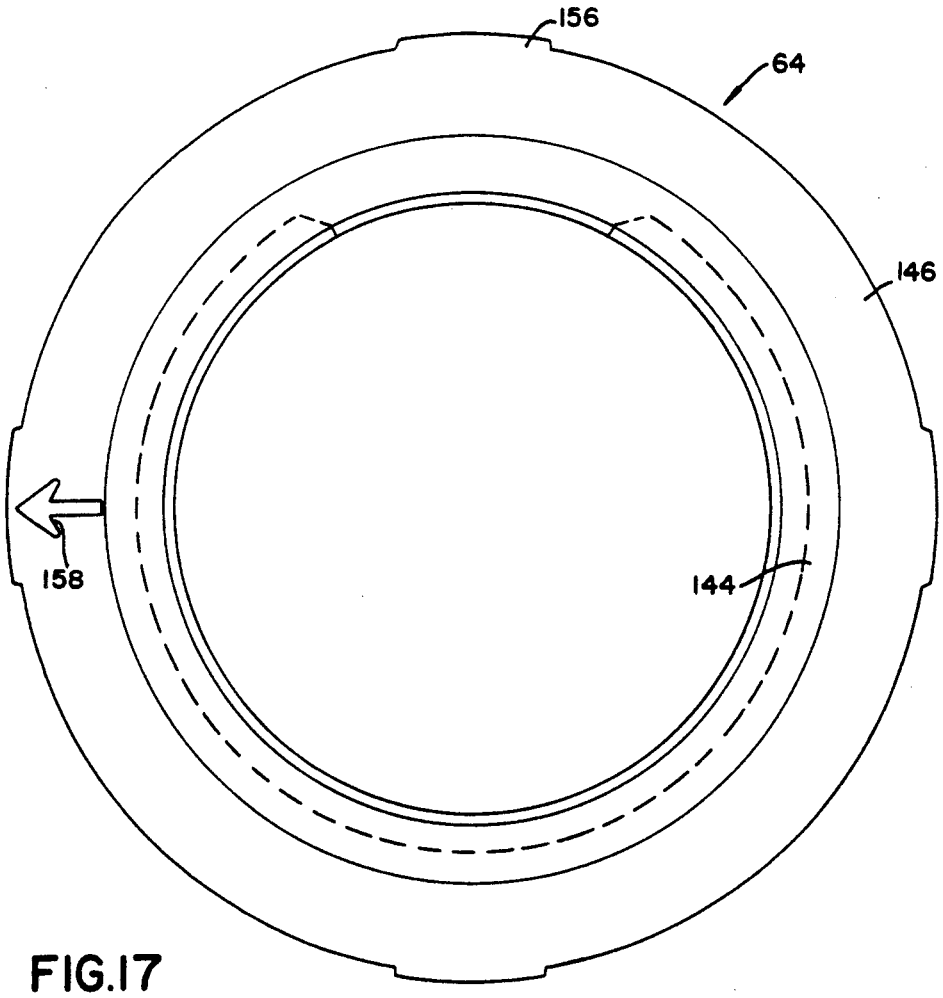
FIG.17

INEXPENSIVE ABRASIVE BLAST WHEEL

This invention relates to new and useful improvements in abrasive blast wheels, and more particularly to an abrasive blast wheel which is of a construction so as to be relatively inexpensive as compared to present blast wheels utilizing runnerheads for the mounting of vanes.

BACKGROUND OF THE INVENTION

Abrasive blast wheels now in use typically include a very expensive runnerhead having radiating slots therein in which a base of a throwing vane is locked. Such a blast wheel is clearly disclosed in U.S. Pat. No. 4,471,583. A conventional runnerhead is in the form of a machined and case hardened cast steel member. The vanes are separately formed and are so locked in the grooves in the runnerheads so as to facilitate replacement.

An attempt has been made to form an inexpensive blast wheel by eliminating the machined and case hardened runnerhead through the casting of the vanes and the normal impeller in one piece as disclosed in U.S. Pat. No. 4,723,379. However, because the vanes must be replaced as they wear out, it is necessary to not only replace the vanes, but also the complete unit which includes the impeller at a high cost. Therefore, such a blast wheel construction is not commercially feasible in cases of high usage.

SUMMARY OF INVENTION

In accordance with this invention, it is proposed to entirely eliminate the conventional machined and case hardened runnerhead and replace it with an inexpensive machined steel part in the form of a hub which is generally bowl shaped and includes a peripheral flange which serves to restrain bases of vanes seated within the hub against radially outwardly directed movement. In lieu of the simple impeller, there is provided a slightly more complex impeller which includes a mounting plate portion having cast radially outwardly directed slots or notches therein. The impeller is clamped relative to the hub and the provided for slots receive a spacer portion of each of a plurality of vanes and overlies a wider base of such vanes.

Each vane base is provided with an outer end contoured to match the hub flange so as to prevent radially outwardly directed movement of the individual vane.

This invention also relates to other features of the inexpensive blast wheel including the specific mounting of the hub on a drive shaft, the provision of a simple impeller case which is rotatably adjustable relative to the impeller so as to control the direction in which a blast stream from the vanes is directed. The impeller case is simply clamped to a guard housing for rotation relative to the guard housing and thus controls the point at which abrasives are directed to the impeller for distribution to the vanes.

With the above and other objects in view that will hereinafter appear, the nature of the invention will be more clearly understood by reference to the following detailed description, the appended claims, and the several views illustrated in the accompanying drawings.

FIG. 5 is a schematic plan view of the impeller seated on the hub and with a single vane mounted therebetween.

FIG. 6 is a sectional view taken generally along the line 6—6 of FIG. 5 and specifically shows the relationship of the hub, impeller and one vane in the mounting of a vane.

FIG. 7 is a plan view similar to FIG. 5 and shows the impeller and the one vane rotated to a position from which the one vane may be radially removed from between the hub and the impeller.

FIG. 8 is a vertical sectional view showing the manner in which the one vane of FIG. 7 is releasably positioned between the impeller and the hub.

FIG. 11 is a plan view of a typical vane.

FIG. 12 is a side elevational view of the vane of FIG. 11.

FIG. 13 is an end elevational view of the vane of FIG. 11 as viewed from the left.

FIG. 14 is an end elevational view of the vane of FIG. 11 as viewed from the right.

FIG. 15 is a bottom plan view of the vane of FIG. 11.

FIG. 16 is a vertical sectional view taken through the impeller cage showing the arrangement of the flow control slot formed therethrough.

FIG. 17 is an elevational view of a flange end of said impeller cage and shows the relationship of markings thereon.

DESCRIPTION OF PREFERRED EMBODIMENT OF INVENTION

Figure 1:
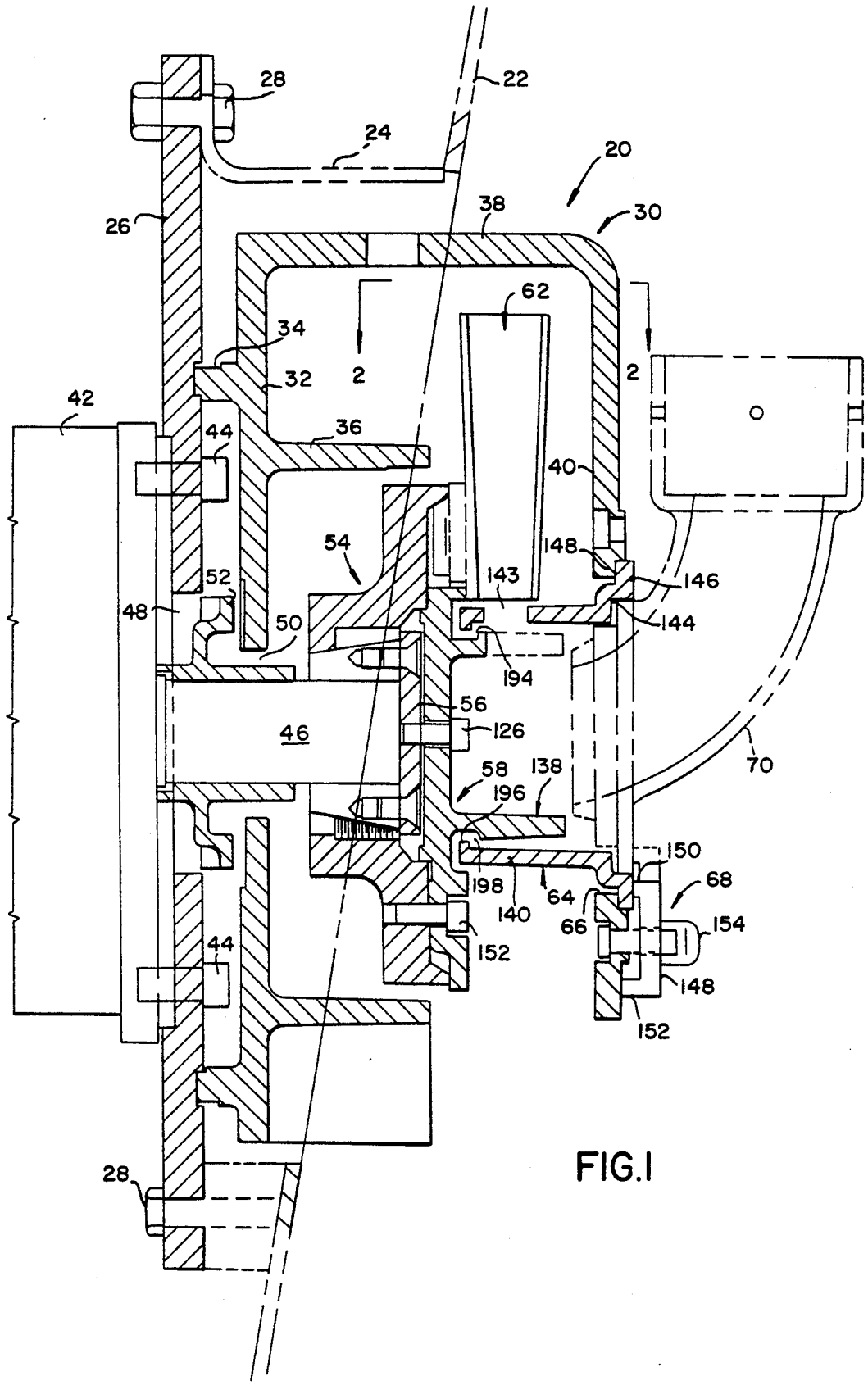
FIG. 1 is a vertical sectional view taken through the inexpensive blast wheel showing the details of the complete construction thereof.

Referring now to the drawings in detail, and most particularly to FIG. 1, it will be seen that there is illustrated in section an inexpensive blast wheel formed in accordance with this invention. The blast wheel is generally identified by the numeral 20 and is carried by a suitable machine component 22 by means of a bracket unit 24.

The blast wheel 20 includes a mounting plate 26 which is fixedly, but removably, secured to the bracket unit 24 by way of bolts 28.

The mounting plate 26 carries a guard housing generally identified by the numeral 30. The guard housing 30 includes a plate portion 32 which is provided with a spacer ring 34 which is suitably seated on the mounting plate 26 with the plate 32 being releasably secured to the mounting plate 26 in a manner not shown.

The guard housing 30 also includes a shielding ring 36 which extends from the opposite face of the plate 32. Further, the guard housing 30 includes a main body portion 38 which extends only partially about the periphery of the blast wheel 20. Finally, the guard housing 30 includes a front plate 40.

The mounting plate 26 has removably secured to the rear face thereof a suitable motor 42 by way of bolts 44.

The motor 42 includes a drive shaft 46 which extends through aligned openings 48 and 50 in the mounting plate 26 and the plate 32, respectively.

A suitable slinger 52 is carried by the shaft 46 generally between the mounting plate 26 and the plate 32 and partially within the opening 48.

The drive shaft 46 carries a hub, generally identified by the numeral 54, in a manner which will be described in detail hereinafter. The means for mounting the hub 54 and the drive shaft 46 includes a plate 56 at the end of the drive shaft 46. The plate 56, as will be described in more detail hereinafter, is utilized in the mounting of an impeller which is generally identified by the numeral 58 utilizing a centrally located bolt 126. The impeller 58 is utilized in a manner to be described hereinafter, in the mounting of throwing vanes 62 on the hub 54.

The impeller 58 has associated therewith a case, generally identified by the numeral 64 for the controlled delivery of abrasive particles to the impeller 58 for distribution to the vanes 62. The case 64 is mounted in an opening in the front plate 40 of the guard housing 30 and is releasably secured in place by a plurality of clamp units generally identified by the numeral 68. A lower end of a spout 70 opens into an end of the case 64 generally in alignment with the impeller 58 for supplying abrasives directly to the impeller 58.

VANE

Reference is now made to FIGS. 11–15 wherein there is illustrated the details of a vane which is one of a number of important elements of the blast wheel 20. While the illustrated vane 62 is provided with a straight blade portion, the blade portion being identified by the numeral 72, it is to be understood that the blade portion may equally as well be of a curved outline. The blade portion 72, as is best shown in FIGS. 12, 13, 14, is generally I-shaped in cross section and includes a body 74 which increases in width radially outwardly and is generally defined by a pair of diverging flanges 76, 78.

Adjacent a radially inner end of the blades 72, the flange 78 is provided with a projecting spacer 80 of the same width as the flange 78 as is best shown in FIGS. 13, 14.

The spacer 80, in turn, carries an integral mounting base 82 which, as is best shown in FIG. 12, is slightly shorter than the spacer 80 in the length direction of the vane 62. The mounting base 82 further is of a greater width than the spacer 80 and extends to opposite sides of the spacer 80 as is best shown in FIGS. 13, 14.

With reference to FIG. 15, it will be seen that the mounting base 82 has a radially outer end 84 which is generally arcuate in outline except for a flat central portion 86. It is to be noted that the end 84 slopes generally towards the flange 78 and radially outwardly as is best shown in FIG. 12.

Figure 3:
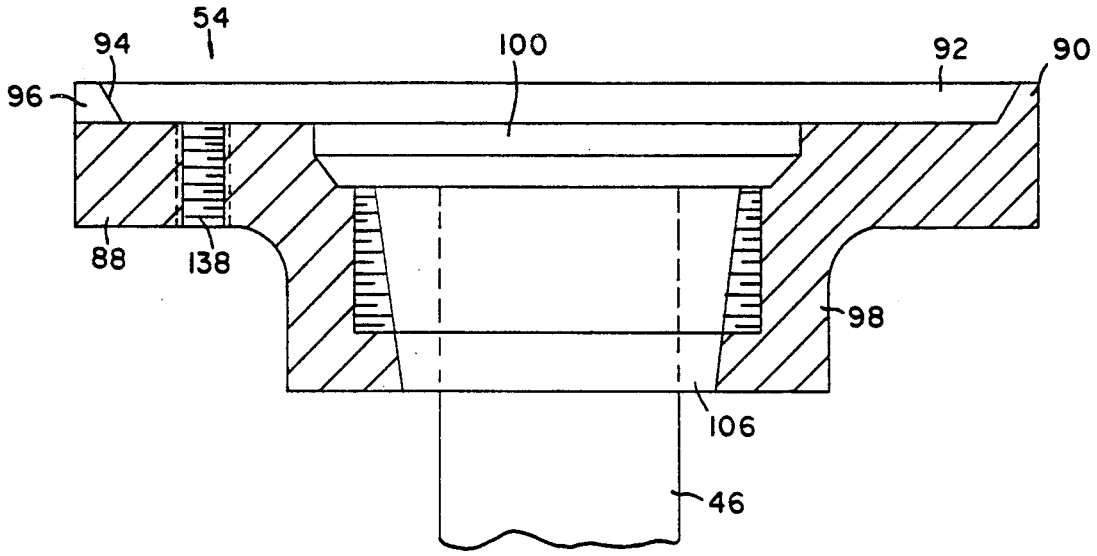
FIG. 3 is a sectional view through the center of the hub showing the specific constructional details thereof.

Referring now to FIG. 3, it will be seen that the hub 54, which replaces the usual runnerhead, has an upper plate portion 88 which is provided with an integral uppermost and radially outermost flange 90 to define an upper bowl 90. The flange 92 has an inner surface 94 which slopes both radially outwardly and upwardly and forms a vane retaining shoulder as will be described in more detail hereinafter. The flange 90 may be provided with a notch 96 which extends radially therethrough for a purpose to be described in detail hereinafter.

The plate 88 is provided with an integral mounting hub 98 which is aligned with a central recess 100 formed in the plate 88.

Figure 2:
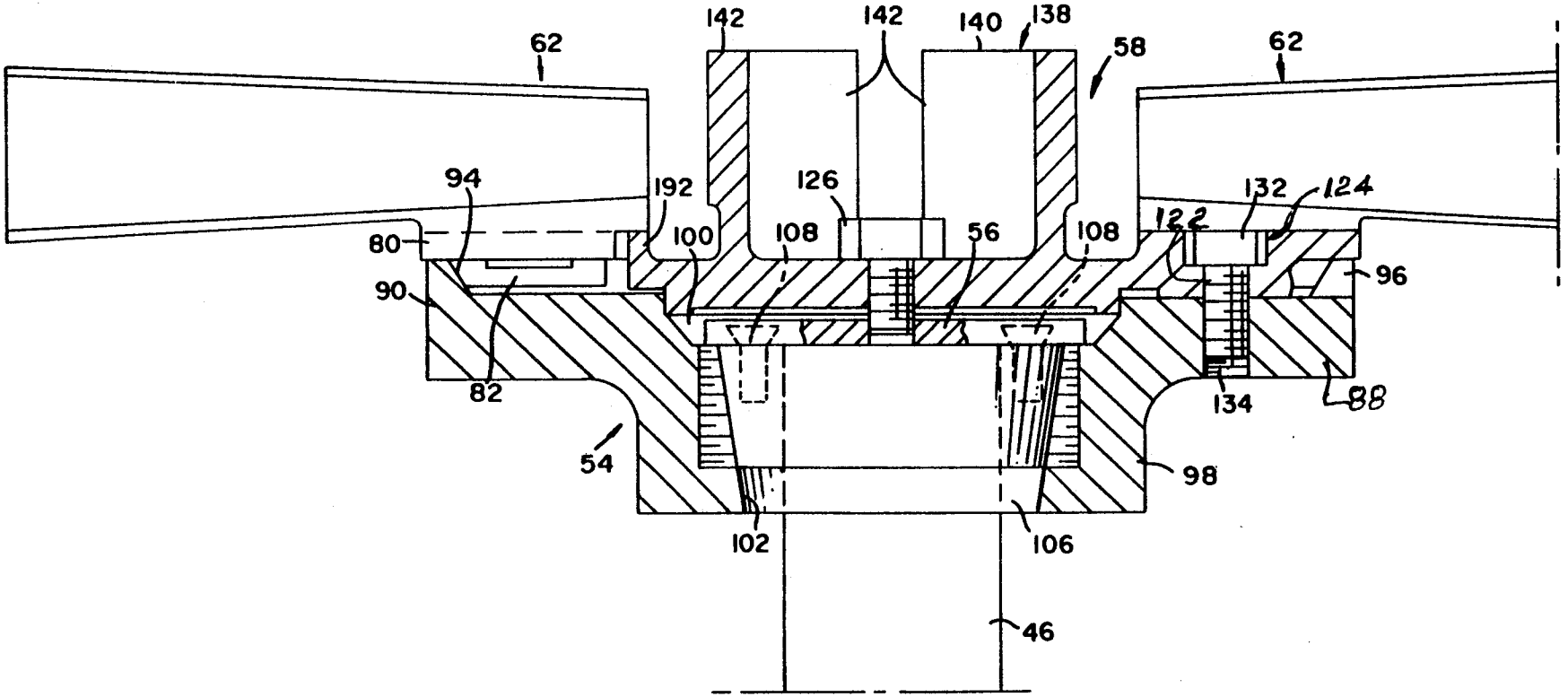
FIG. 2 is an enlarged fragmentary sectional view taken generally along the line 2—2 of FIG. 1 and shows the specific relationship of the hub, the shaft mounting the hub, vanes and the impeller.

Referring now to FIG. 2, it will be seen that the mounting hub 98 is provided with a downwardly tapering bore 102 to receive a conventional taper lock bushing 106 as is best shown in FIG. 3.

The taper lock bushing 106 is telescoped over the end of the drive shaft 46 and is wedged within the tapered bore 102. Suitable wedge deforming and retaining means are driven into the bore 102 to fix the bushing 106 within the tapered bore 102.

The previously mentioned plate 56 is positioned within the lower part of the recess 100 and is fixedly secured to the bushing 106 by fasteners 108, as is best shown in FIG. 2.

Figure 4:
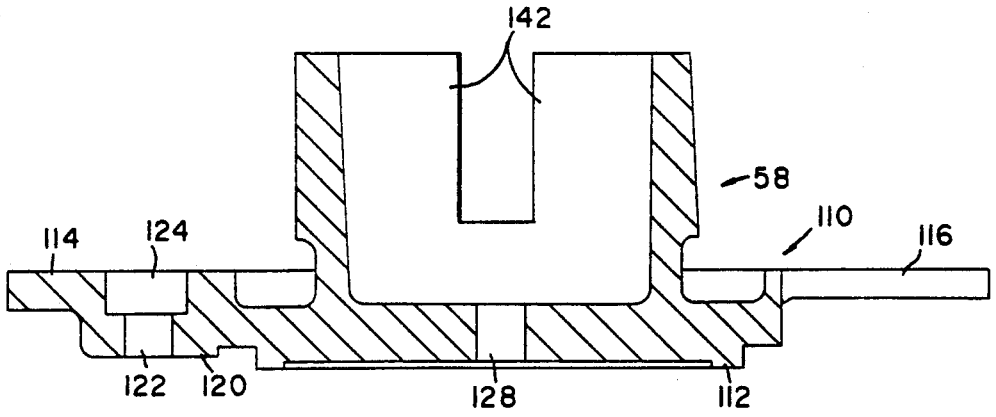
FIG. 4 is a sectional view through the center of the impeller showing the specific details thereof.
Figure 9:
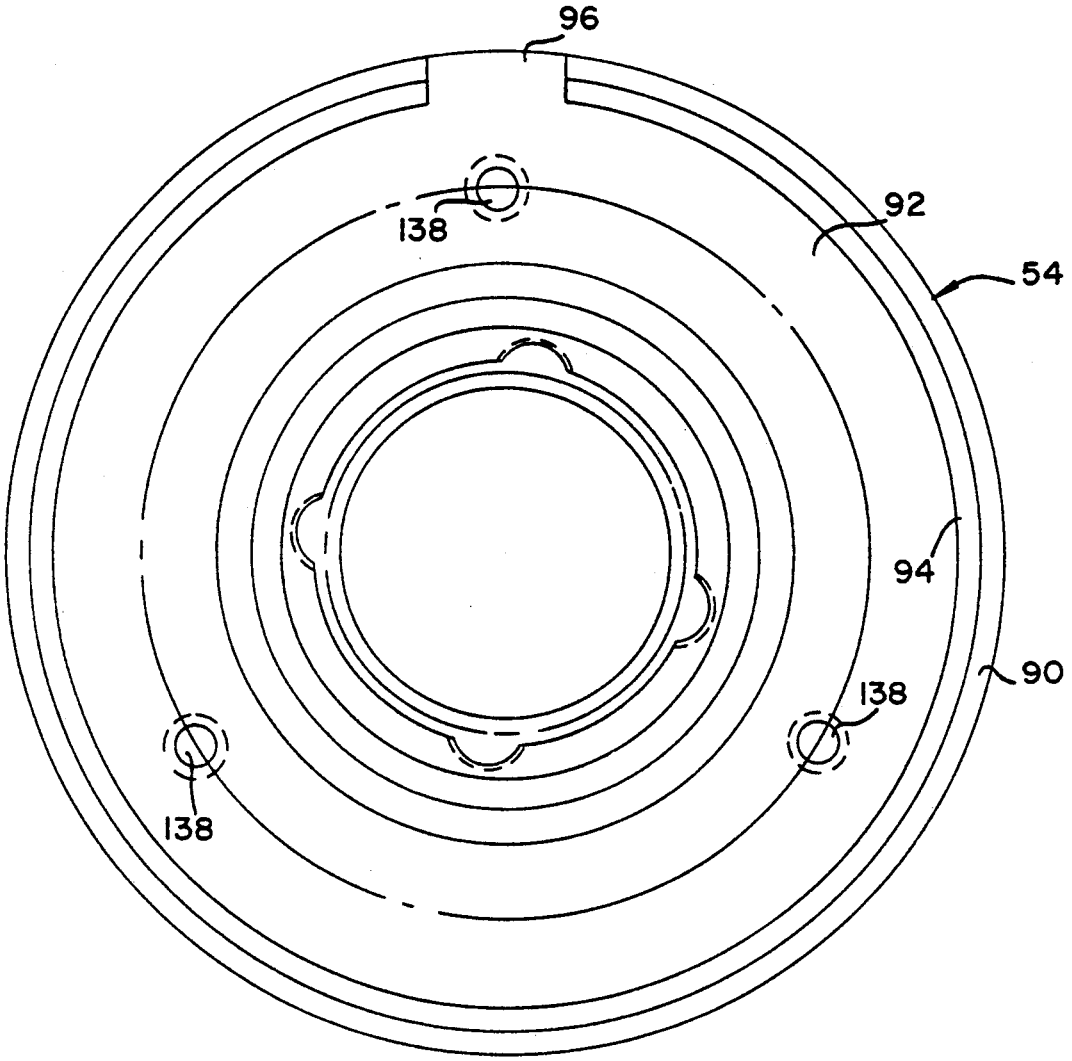
FIG. 9 is a plan view of the hub and shows generally the details thereof.
Figure 10:
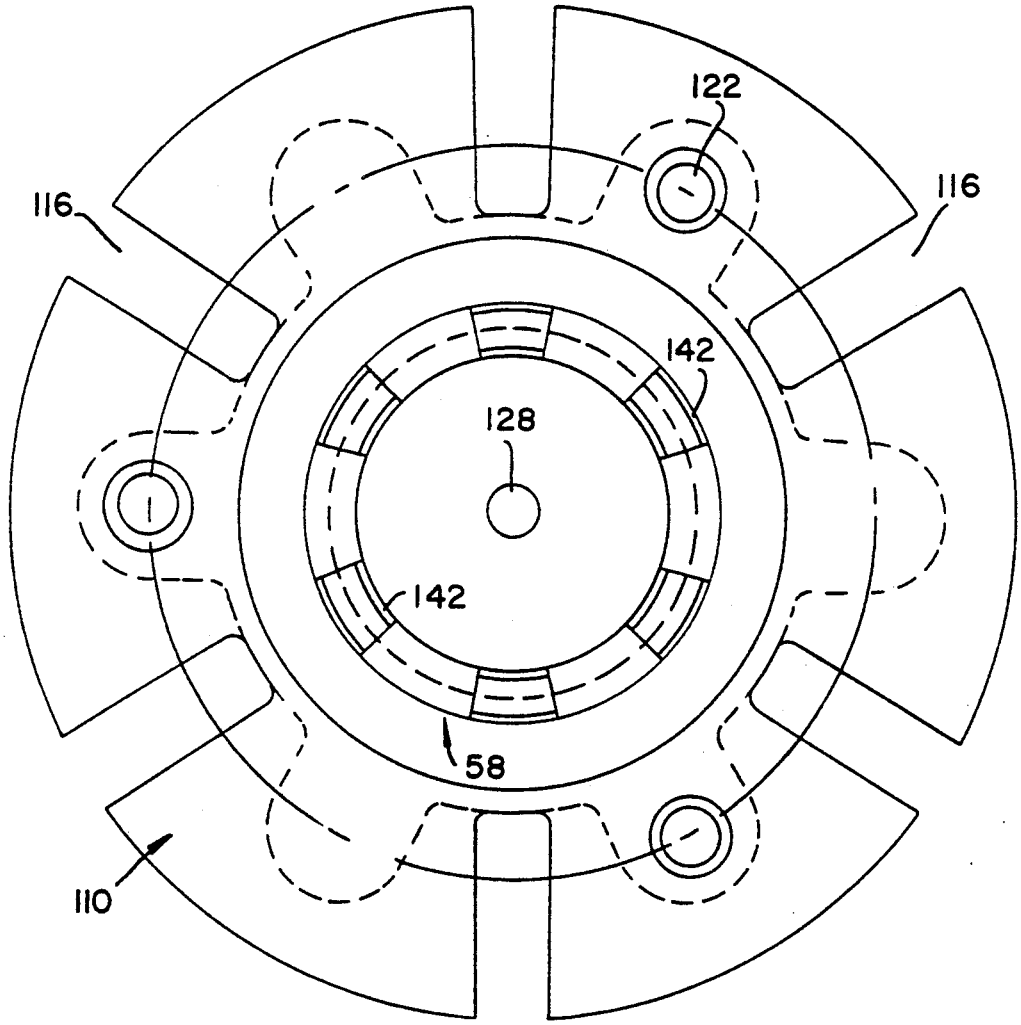
FIG. 10 is a plan view of the impeller and shows generally the details thereof.

Reference is now made to FIG. 4 wherein there is illustrated the details of the impeller, generally identified by the numeral 58. The impeller 58 includes a plate generally identified by the numeral 110. The plate 110 includes a lower boss 112 which seats in the upper portion of the recess 100 as is clearly shown in FIGS. 1 and 2.

The plate 110 includes a peripheral portion 114 which, as is best shown in FIG. 5, is provided with a plurality of circumferentially spaced radially outwardly opening notches 116. There is one notch 116 for each of the vanes 62 and the circumferential spacing of the notches 116 is in accordance with the number of vanes 62 which may be varied from four to eight in number.

Between each of the notches 116, the peripheral plate portion 114 is reinforced by a plurality of integral bosses 120 formed on the underside thereof.

At least certain of the bosses 120 is provided with a bore 122 therethrough which is an extension of a countersink 124 formed in the upper part of the outer plate portion 114.

Referring now to FIGS. 2 and 6, it will be seen that when the impeller 58 is seated on the hub 54, the impeller 58 is secured in place by the bolt 126 which passes through a bore 128 in a central portion of the plate 110 and is threaded into an internally threaded bore 130 in the plate 56. Further, as is best shown in FIG. 2, the impeller 58 is additionally secured to the hub 54 by bolts 132 passing through the bores 122 and being threaded into internally threaded bores 134 formed in the plate 88 of the hub 54. Heads of the bolts 132 are positioned within the counterbores 124.

As is best shown in FIG. 5 and 6 the spacer 80 of each of the vanes 62 is seated within an associated notch 116 in the impeller plate 114. The impeller plate 114 on each side of each notch 116 overlies the vane base 82 and holds each vane base within the bowl portion 92 of the hub 54. At the same time, the outer end 84 of each vane base 82 abuts against the surface 94 of the flange 90 so as to restrain an associated vane 62 against further radially outwardly directed movement.

It will be further seen that the impeller 58 includes an impeller member 138 which projects from the impeller plate 110. The impeller 138 has an open end 140 remote from the impeller plate 110 and is generally in the form of a sleeve. The impeller 138 is provided with a plurality of circumferentially spaced, axially extending and radially outwardly directed fingers 142. There is one finger 142 for each of the vanes 62 with the fingers 142 being generally aligned with the vanes 62 so as to direct abrasive particles radially outwardly to each associated vane 62.

The timing of the flow of abrasive particles to the vane 62 from the impeller 58 is controlled by the case 64. As is clearly shown in FIG. 1, the case 64 is in the form of a sleeve 140. The sleeve 140 is provided with an opening 143 through which abrasive particles are thrown by the impeller 58. The position of the opening 143 controls the path of the blast of abrasive particles from each vane 62.

The case 64 is adjustably carried by the front plate 40 and includes a generally Z-shaped flange arrangement 144 which terminates in an outermost flange 146. The flange 146 is circular in outline and is seated in an annular recess 148 in the plate 40 surrounding the opening 66.

As previously described, the case 64 is adjustably secured in place by way of clamp units 68. Each clamp unit 68 includes a clamp member 148 having at the opposite ends thereof an inner leg 150 and an outer leg 152. Each leg 152 engages the plate 40 while each leg 150 engages the flange 146. A bolt unit 154 serves to releasably hold the clamp 148 in place.

When the clamp units 68 are loosened, the case 140 may be rotated so as to change the position of the opening 143 and thus change the path of the blast of abrasive particles.

Referring now to FIG. 16, it will be seen that the opening 143 flares radially outwardly so as to facilitate the flow of abrasive particles through the opening 143 onto that vane 62 which is at that time aligned with the opening 143.

Also, as is shown in FIG. 17, the flange 146 of the case 64 has suitable indicia on the exposed face thereof. This indicia includes the word SLOT as at 156 and there is a depressed arrow 158 for identifying the direction of abrasive blast from the vanes 62. Suitable indicia (not shown) is provided on the guard housing 30 for association with the arrow 158 to properly position the opening 143 for the desired blast of abrasive particles.

MOUNTING OF AND REPLACEMENT OF VANES

Referring now to FIGS. 2 and 8, it will be seen that the flange 90 of the hub 54 is provided with the notch 96 which is of a width generally equal to, but slightly greater than the width of the base 82 of a vane 62. A vane 62 may readily be removed from between or inserted between the impeller 58 and the hub 54 by first removing the bolts 132 which fixedly secure the impeller 58 to the hub 54. Then the bolt 126 is loosened so that the impeller 58 is free to rotate relative to the hub 54. Having accomplished this, the impeller 58 is rotated so that one of the notches 116 of the impeller 58 is aligned with the notch 96. When the impeller 58 is so positioned relative to the hub 54, a vane 62 may be either removed from the hub 54 or inserted thereinto.

After a vane 62 has been so inserted into the hub 54, when the impeller 58 is rotated relative to the hub 54, the base 82 of that vane will be within the bowl portion of the hub 54 defined by the flange 90 and beneath the plate portion of the impeller 58 so as to be retained in place. This process is continued until either the hub 54 has been filled with the vane 62 during the original assembly or all the vanes 62 have been replaced.

Figure 18:
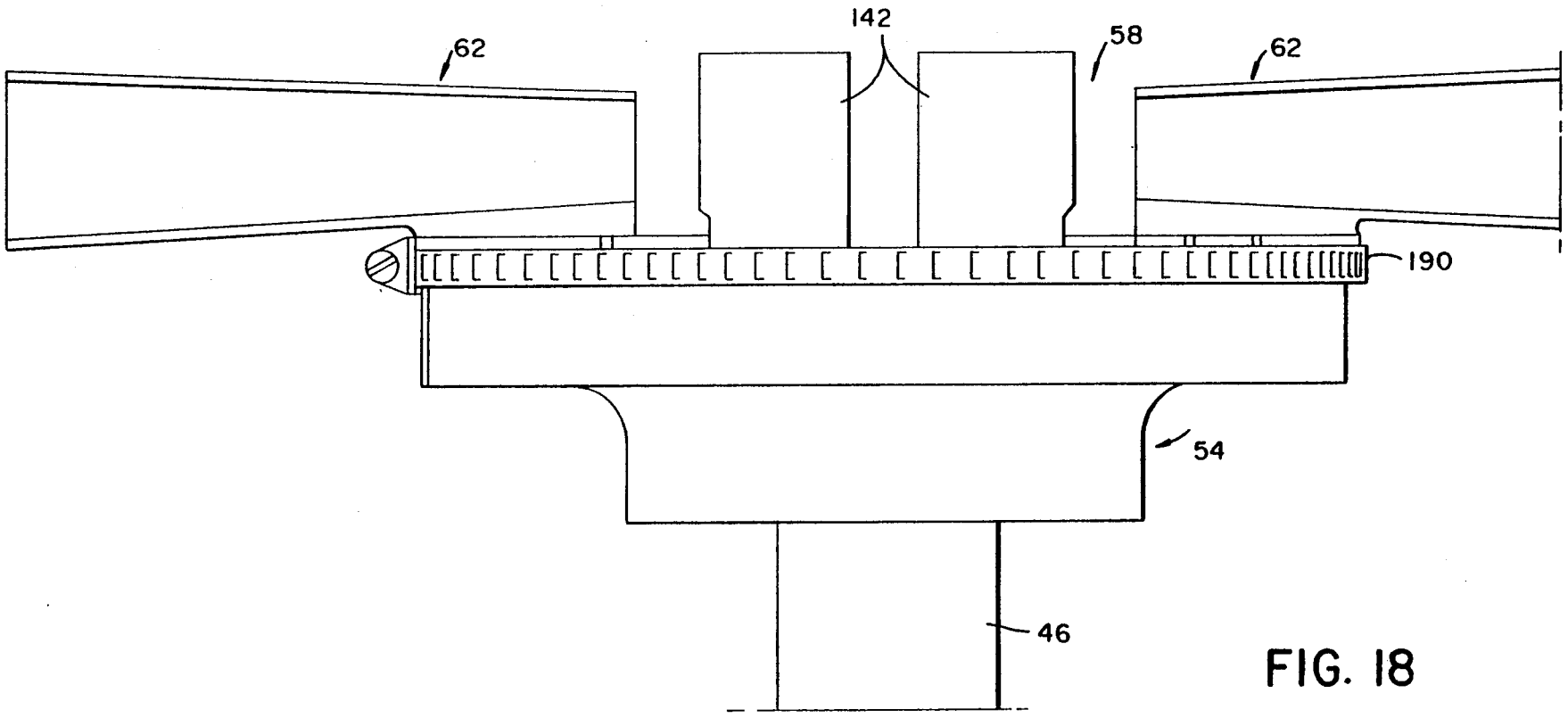
FIG. 18 is an elevational view of the impeller, the hub and two vanes and shows an alternative manner of mounting the vanes with respect to the hub.

On the other hand, the vanes 62 may all be assembled at one time with the impeller and the impeller and vanes then assembled with the hub 54. This is best shown in FIG. 18. This is accomplished by positioning each of the vanes 62 in its respective notch 116 and then engaging a large diameter hose clamp 190 with the outer ends of the spacers 80 of the vanes 62. This will engage the inner ends of the spacers 80 with an upstanding annular flange 192 on the plate portion of the impeller 58. At this time, the vanes 62 and the impeller 58 form a readily handleable unit which may be seated on the hub 54. Thereafter the impeller 58 is clamped to the hub 54 utilizing the bolts 132.

This mode of assembling all of the vanes 62 simultaneously with the hub 54 may be utilized even if the impeller 58 is mounted for rotation relative to the hub 54 utilizing the bolt 126 and the hub 54 is provided with the notch 96.

Returning once again to FIG. 1, it will be seen that the impeller member 138 is provided externally thereof at the base thereof with an annular groove 194. Further, the sleeve 140 of the case 64 is provided at the inner end thereof with a radially inwardly projecting flange 196. The flange 196 is aligned with the annular groove 194 and together with the groove 194 defines a torturous passage 198 so as to impede the flow of abrasive between the case 64 and the impeller 138.

While only straight vanes 62 have been specifically illustrated and described, it is to be understood that the blast wheel is very versatile in that it can also be furnished with straight reversible vanes, curved vanes, flared curved or straight vanes, or vanes of other lengths, all without changing other wheel parts. Furthermore, the specific mounting of the vanes 62 eliminates the expense of slot and pin machining required on current blast wheels.

The impeller case of this blast wheel also provides a definite advantage. The usual way to determine the direction of the blast stream from the vanes is to set an indicator mark on the impeller case to a clock dial position such as 7:30. It can be very confusing to an operator, especially persons with no experience with blast wheels, as to what clock setting is to be used to direct a blast of abrasive particles towards the work to be cleaned.

The setting of the impeller case is also very confusing to even people having experience with blast wheels in that the setting for clockwise rotation is quite different from the setting for counterclockwise rotation.

If the operator of the blast wheel wishes to change the direction of blast, he must remember that each hour on the clock dial is a 30 degree direction change, and then he has to estimate how far a given degree or clock setting change will move the blast of abrasive particles at some given distance from the blast wheel.

In accordance with this invention, by providing the impeller case 64 with the arrow 158 on the flange 146 thereof, and this arrow 158 is located approximately at the radius of the source circle of abrasive particles to the vanes 62, the arrow always points in the direction of the blast of abrasive particles. If one wants to blast straight down, point the arrow straight down. If one wants to blast at some other point, simply point the arrow 158 to this new position. Other advantages of the blast wheel will become readily apparent to a user.

Although only a preferred embodiment of the blast wheel has been specifically illustrated and described herein, it is to be understood that minor variations may be made in the blast wheel without departing from the spirit and scope of the invention as defined by the appended claims.

I claim:

1. A hub, radially extending vanes and impeller plate combination for a blast wheel, said combination comprising said hub being bowl shape and including a peripheral upstanding flange to function as a runnerhead, each of said vanes including an anchoring base of a transverse width greater than a remainder of said vane and said anchoring base having a radially outer end complementary to said upstanding flange, said impeller plate having a plurality of radial slots each opening radially outwardly, there being one radial slot for each of said vanes, each of said radial slots receiving a radially inner end portion of a respective one of said vanes with material of said impeller plate on each side of each of said radial slots being seated on said anchoring base of said respective vane, and releasable means releasably axially securing said impeller plate relative to said hub to axially clamp said vane bases to said hub with said vanes being retained against radial outward movements by said vane anchoring base end engaging said hub flange.

2. The combination of claim 1 wherein each vane base is connected to the vane of which it is a part by a spacer, and said spacer being received in a slot in said impeller plate.

3. The combination of claim 1 wherein said upstanding flange and said anchoring base end slope at an acute angle to a plane of said radially outer hub.

4. The combination of claim 1 wherein said vanes are initially assembled with said impeller plate and clamped together by a clamping band engaging said vane anchoring bases and forcing said vane anchoring bases against radially inner ends of said slots.

5. The combination of claim 1 wherein said releasable means includes a central pivot about which said impeller plate can rotate relative to said hub, and said hub upstanding flange has a radial slot through which said vanes may be individually replaced by aligning an impeller slot and a vane seated therein with said hub upstanding flange slot.

6. The combination of claim 5 wherein there are removable fasteners fixedly securing said impeller to said hub.

7. The combination of claim 1 wherein said releasable means includes a central pivot about which said impeller plate is rotatable relative to said hub.

8. The combination of claim 1 wherein said releasable means includes a central pivot about which said impeller plate is rotatable relative to said hub, and removable fasteners fixedly secure said impeller plate to said hub.

9. A blast wheel vane comprising a vane member having inner and outer ends, and said vane member having at said inner end a lower mounting base separated from said vane member by a spacer, wherein said base is wider than said spacer and extends to opposite sides of said spacer.

10. A vane according to claim 9 wherein said base has an outer vane restraining end.

11. A vane according to claim 9 wherein said base has an outer vane restraining end which slopes upwarding and outwardly.

12. A vane according to claim 9 wherein said base has an outer vane restraining end which slopes upwarding and outwardly and is arcuate when viewed in plan.

13. A blast wheel impeller plate comprising a plate, fastening means carried by said plate for securing said plate relative to a runnerhead for rotation with such runnerhead, a slinger sleeve carried by said plate, said plate having a plurality of peripherally spaced radially outwardly directed slots for positioning vanes, said slinger sleeve having a plurality of fingers with each finger being positioned relative to a respective one of said slots for directing abrasives onto a vane when seated in a respective slot.

14. An impeller plate according to claim 13 wherein said fastening means includes a central fastener hole for receiving a central retaining fastener having a secondary function of being a pivot.

15. An impeller plate according to claim 13 wherein said slinger sleeve has a circumferentially outer surface, and there is a groove in said circumferentially outer surface adjacent said plate for cooperation with an outer case to define a restricted abrasive passage.

16. A low cost blast wheel comprising a mounting plate, a guard housing carried by said mounting plate, said mounting plate and said guard housing having aligned shaft receiving openings, a hub positioned within said guard housing for mounting on a shaft and for rotation with such shaft, said hub being generally bowl shaped and including a peripheral vane retaining flange, said hub having a mounting hub, a plurality of vanes carried by said hub, each of said vanes having a base seated in said bowl shaped hub, an impeller plate clamping said vane bases in said hub, said impeller plate being releasably secured to said runnerhead and having a plurality of circumferentially spaced radially outwardly opening slots for receiving and positioning said vanes, each vane base being wider than a respective slot with said impeller plate engaging each vane base in clamping relation, each said vane bases having a radially outer end engaging said vane retaining flange, said impeller plate including a notched slinger sleeve for directing abrasives radially outwardly towards said vanes, a case telescoped over said slinger sleeve and being fixedly clamped to said guard housing, said case having an open end for receiving an abrasive spout and said case having a radially directed opening therethrough for controlling flow of abrasive particles

17. The blast wheel of claim 16 wherein said guard housing has an open area for the flow of abrasives discharged by said vanes, said case is rotatably adjustable relative to said guard housing to control the path of discharge relative to said guard housing, and said case has indicia thereon for facilitating the positioning of said case.

18. A blast wheel hub for supporting vanes, said hub being generally bowl shaped for receiving vane bases and including an upstanding peripheral notched flange for engaging vane bases to retain such vanes in said hub.

19. A blast wheel hub according to claim 18 wherein said upstanding flange is circular in outline.

20. A blast wheel hub according to claim 19 wherein the notch 2 the upstanding flange is a radial notch therethrough of a width to pass a vane base whereby a vane may be removed from and inserted radially relative to said hub.

21. A blast wheel hub according to claim 18 wherein said upstanding flange is circular in outline and slopes axially and radially outwardly.

* * * * *